United States Patent [19]

Coxon

[11] 4,019,324

[45] Apr. 26, 1977

[54] INTERNAL COMBUSTION ENGINE

[76] Inventor: John R. Coxon, "Penfound," Stane St., Pulborough, England

[22] Filed: Sept. 3, 1975

[21] Appl. No.: 609,967

[30] Foreign Application Priority Data

Sept. 11, 1974 United Kingdom ..... 39678/74

[52] U.S. Cl. ..... 60/624; 60/609; 60/595; 123/119 C; 123/119 CD

[51] Int. Cl.[2] ..... F02G 3/00

[58] Field of Search .... 123/119 C, 122 D, 119 CD, 123/65 BA, 65 B; 60/595, 598, 605, 609, 604, 624

[56] References Cited

UNITED STATES PATENTS

| | | | |
|---|---|---|---|
| 2,570,101 | 10/1951 | Couling | 60/624 |
| 2,585,968 | 2/1952 | Schneider | 60/609 |
| 2,645,897 | 8/1953 | Sammons | 60/609 |
| 2,652,685 | 9/1953 | Willgoos | 60/624 |
| 3,050,923 | 8/1962 | Muller | 60/624 |
| 3,974,802 | 8/1976 | Lundquist | 123/122 D |

*Primary Examiner*—Ronald H. Lazarus
*Attorney, Agent, or Firm*—Brisebois & Kruger

[57] ABSTRACT

In order to make better use of the energy which is generated by the combustion of fuel and air in an internal combustion engine, such an engine is provided with a turbine through which the hot exhaust combustion gases are expanded to drive a power output shaft of the turbine, a compressor for compressing the air drawn into the engine, and passages extending in the engine around the combustion chamber or chambers through which pass the compressed air which is not used for combustion, this air extracting heat from the engine and being expanded through the turbine to assist the exhaust gases in driving the turbine output power shaft.

17 Claims, 4 Drawing Figures

INTERNAL COMBUSTION ENGINE

This invention relates to internal combustion engines, and according to the invention such an engine comprises a combustion chamber bounded by a cylinder, a cylinder head, and a piston which is arranged to reciprocate in the cylinder and is connected to a crankshaft, the combustion chamber having inlet and exhaust ports, an air intake, means for compressing the air and feeding it to an inlet duct which communicates with the inlet ports for supplying air to the combustion chamber for combustion with fuel to drive the piston and hence the crankshaft, an exhaust duct communicating with the exhaust ports and leading to a turbine which is arranged to be driven by exhaust gases escaping from the combustion chamber through the exhaust duct and the turbine, and passages which lead from the inlet duct and extend closely around the combustion chamber so that, in use, compressed air flowing through the passages from the inlet duct extracts heat from the engine surrounding the combustion chamber, the passages being arranged so that the heated compressed air assists the exhaust gases from the combustion chamber in driving the turbine.

In contrast with conventional internal combustion engines in which most of the combustion heat which is lost to the engine block and cylinder head is wasted by being taken up by a cooling medium and dissipated to the atmosphere, the engine in accordance with the present invention is designed to make use of this heat to increase the power output of the engine. In this case, at least part of the engine, particularly in the region of the air passages surrounding the combustion chamber, is preferably insulated to restrict heat loss to the atmosphere and to ensure that as much heat as possible is given up to the compressed air flowing through the passages, which preferably connect the inlet and exhaust ducts. The heat taken up by the air flowing through these passages increases the pressure of the air which, together with the hot combustion gases which are exhausted under pressure from the combustion chamber, expand through the exhaust turbine causing the turbine rotor to rotate and provide power at the rotor shaft.

The exhaust turbine, which may be of the linear or centrifugal type, may in fact be a multi-stage turbine provided that the gases exhausting through the turbine are capable of driving the rotors. It is envisaged that the power output of the turbine, i.e., at the rotor shaft, will be greater than that of the crankshaft driven solely by the pistons, and while the turbine may be coupled to the crankshaft, either directly or through gears, to drive a common power take-off connection, it is thought that more use may be made of the engine with the power provided by the turbine being used independently of that provided by the crankshaft.

Preferably the means for compressing the air and feeding it to the inlet duct comprises a centrifugal impeller which is arranged to be driven by the crankshaft through a gearbox so that the impeller speed is greater than the crank speed, for example, between 2 and 4 times greater. Air is fed continuously under pressure by the impeller to the inlet duct, and at any instant air either flows some into the combustion chamber and some through the surrounding passages, or flows wholly through the passages. Injecting air into the combustion chamber under pressure enables a greater mass of air to be trapped in the chamber for combustion with the fuel, and for a given amount of fuel the efficiency of combustion and the energy released is increased.

The air intake to the impeller is preferably controlled, such as by a throttle valve, in order to vary the speed at which the engine runs. Preferably also, the combustion fuel is supplied to the combustion chamber by means of a fuel injection system which is arranged to inject the fuel directly into the combustion chamber, since in this way the amount of fuel used can be controlled more accurately in accordance with engine speed. Also, the dispersion of the fuel in the combustion chamber can be arranged to provide a most efficient combustion of all the fuel.

The engine is particularly suited for use as a two-stroke engine, the inlet and exhaust ports of the combustion chamber being located in the wall of the cylinder and opening the chamber to the inlet and exhaust ducts respectively when uncovered by the piston as it reciprocates in the cylinder. When the piston is near the bottom of the cylinder and both the inlet and exhaust ports are uncovered, the air under pressure which passes into the combustion chamber from the inlet duct displaces the hot combustion gases through the exhaust ports and a particularly efficient scavenging of the combustion chamber is thus achieved so that each combustion in the chamber occurs with a substantially pure mixture of air and fuel.

The bearings for the rotary parts of the engine, particularly the crankshaft, will be lubricated by oil pumped through suitable ducts and galleries in the usual way, and preferably the oil is pumped through a pipe which is exposed to the air which passes through the air inlet duct or ducts so that heat from the oil is given up through the wall of the pipe to the air. In this way still more of the heat generated by the engine is utilised rather than wasted as in conventional engines.

The engine in accordance with the invention may of course comprise more than one combustion chamber, preferably arranged substantially equi-angularly around a common crankshaft to which the piston of each combustion chamber is connected. In this case the impeller, the crankshaft, and the exhaust turbine are preferably arranged to rotate about a common axis, the impeller feeding air to a separate inlet duct for each combustion chamber, and the exhaust duct from each chamber leading to the turbine.

It is envisaged that good fuel economy and a particularly high power to fuel ratio will be achieved with the engine in accordance with the present invention. It is further envisaged that depending on particular design and the power output achieved, engines in accordance with the invention may be constructed for use in motor vehicles, as outboard or inboard motors in boats, and for aircraft.

An example of a radially arranged three cylinder two-stroke engine in accordance with the present invention will now be described with reference to the accompanying drawings, in which.

Figure 1:
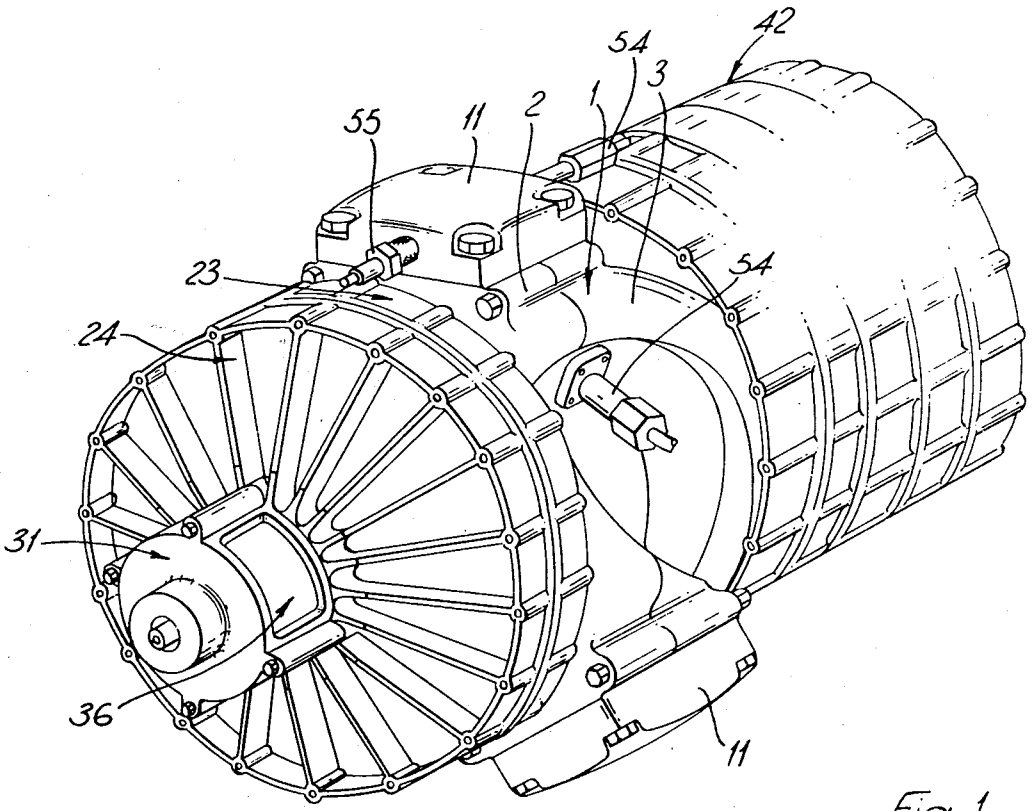
FIG. 1 is a perspective view of the engine.
Figure 2:
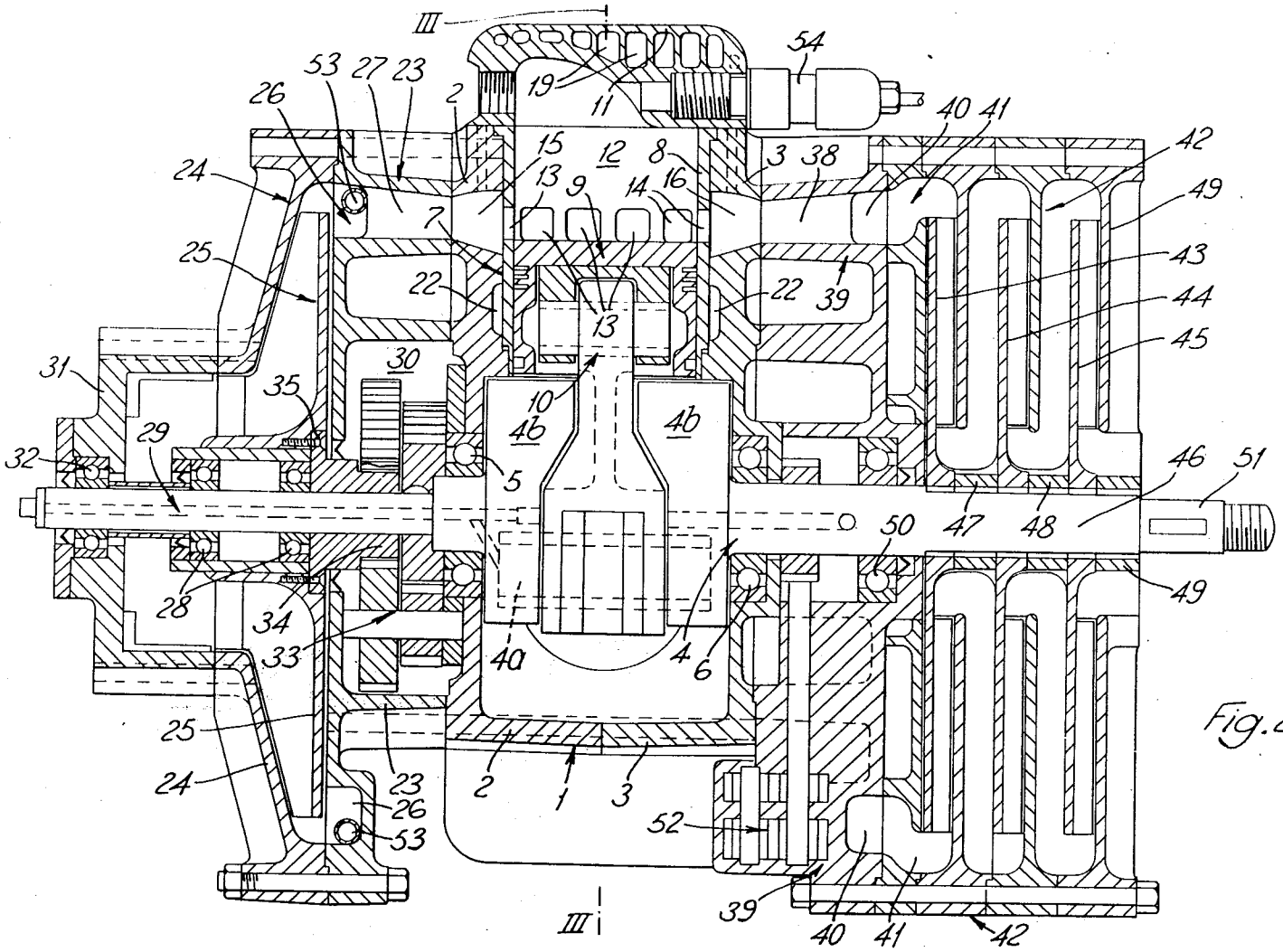
FIG. 2 is a longitudinal section through the engine.
Figure 3:
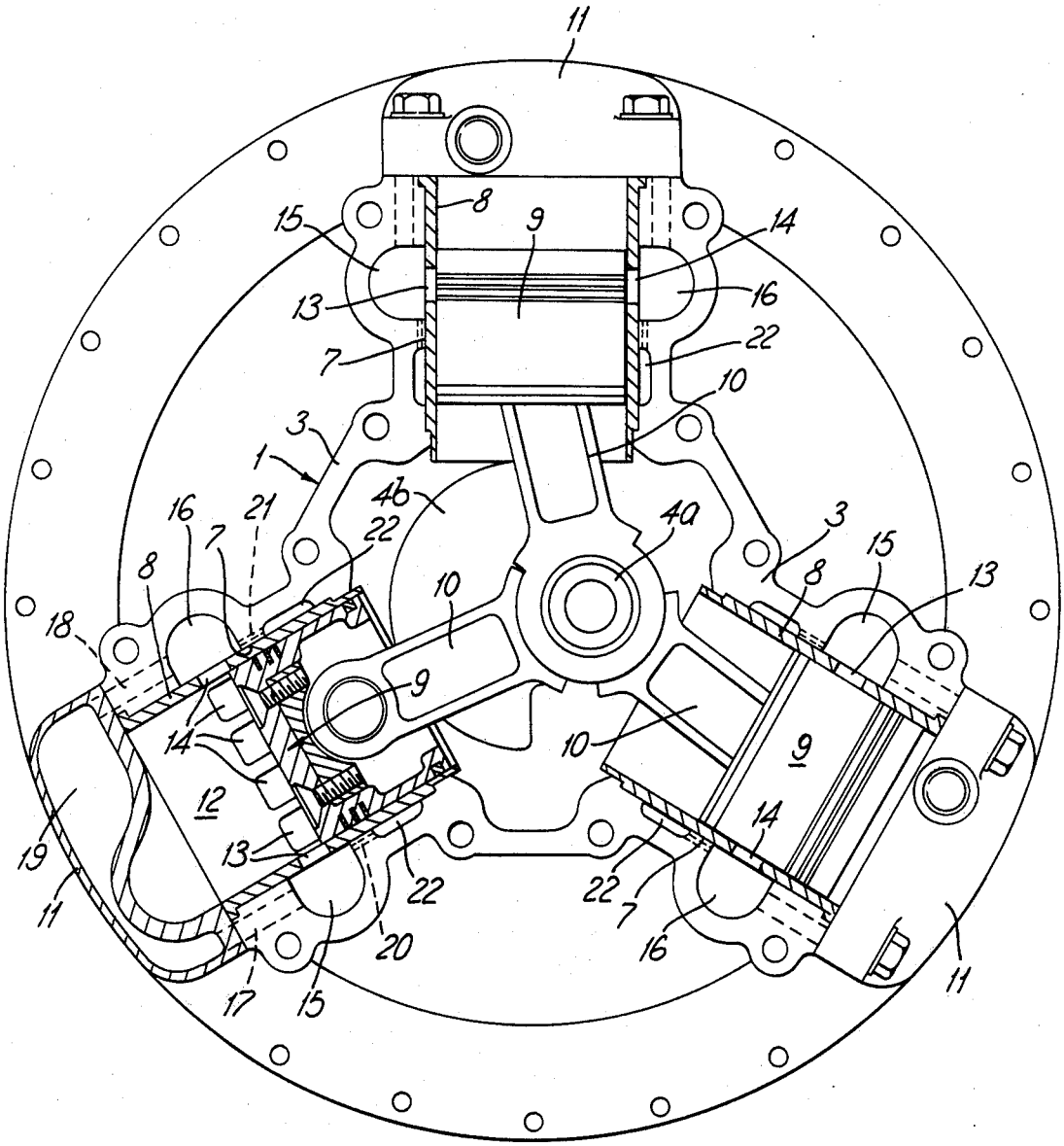
FIG. 3 is a transverse section through the engine, taken on the line III—III in FIG. 2; and, FIG. 4 is a schematic view of the engine illustrating the air and exhaust gas flows through the engine.

The engine is generally cylindrical in shape as shown in FIG. 1. The engine comprises a crank casing 1 which is formed from two halves 2 and 3 which are bolted together in the plane of FIG. 3. A crankshaft 4 is rotatably mounted coaxially within the crank casing 1 by main bearings 5 and 6 which are supported by the two halves 2 and 3 respectively of the crank casing. The crank casing 1 defines three equi-angularly spaced radially extending openings 7 in each of which is located a cylinder 8. Each cylinder 8 contains a piston 9 which is pivotally connected in a conventional manner to one end of a connecting rod 10 which is rotatably mounted upon an eccentric portion 4*a* of the crankshaft 4. The three connecting rods 10 are all mounted on the same eccentric portion of the crankshaft 4 so that as the shaft 4 rotates the three pistons 9 are reciprocated in their cylinders 8 out of phase with each other by 120°. The eccentric portion 4*a* of the crankshaft 4 is balanced by counterweights 4*b* mounted on the shaft. The outer end of each crank case opening 7 and its lining cylinder 8 is closed by a cylinder head 11 which is bolted to the crank casing 1, and the volume enclosed in the cylinder 8 between the cylinder head 11 and the outer face of the reciprocating piston 9 forms a combustion chamber 12.

Figure 4:
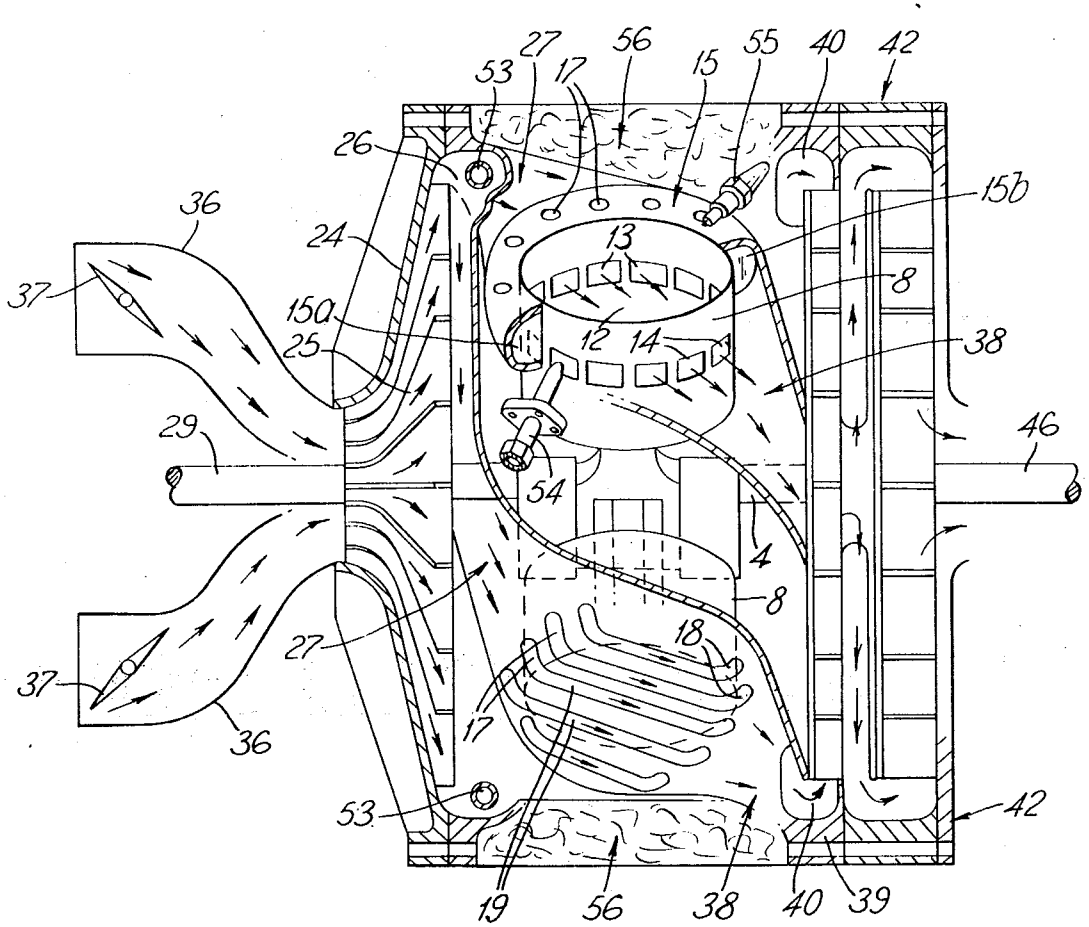

Each cylinder 8 contains a ring of evenly spaced ports 13, 14 of which half form inlet ports 13 which are served by a passage 15 in the crank casing 1 and extending substantially half way around the cylinder 8. The ports 14 form outlet ports which open into a passage 16 which extends in the casing 1 the rest of the way around the cylinder 8 from the passage 15. The passages 15 and 16 are separated from each other at their adjacent ends (as illustrated at 15*a* and 15*b* in FIG. 4), but are in permanent communication with each other firstly by means of a number of ducts 17 and 18 which extend outwards through the crank casing 1 parallel to the cylinder 8 and are connected by cross passages 19 through the cylinder head 11, and secondly by further ducts 20 and 21 which extend inwards from the passages 15 and 16 respectively and are connected by a passage 22 extending in the crank casing 1 circumferentially around the cylinder 8 near its inner end.

Bolted to the crank casing part 2 is an inlet manifold 23 and a blower housing 24 is in turn bolted to the manifold 23, the housing 24 containing an air impeller 25. Around the periphery of the impeller 25 the blower housing 24 communicates with a circumferentially extending passage 26 in the inlet manifold 23. There separate ducts 27 lead from the passage 26 at evenly spaced intervals and extend through the manifold 23 to merge one into each of the passages 15 around the cylinders 8. Each duct 27 and its communicating passage 15 form an air inlet duct for one of the cylinders.

The impeller 25 is rotatably mounted by bearings 28 about a driving shaft 29 which extends coaxially with the crankshaft 4 through the blower housing 24. At one end, the driving shaft 29 is coupled to the crankshaft 4 in a chamber 30 formed within the inlet manifold 23, and at its other end the driving shaft 29 extends through an end cover 31 which is bolted to the housing 24. The cover 31 carries a bearing 32 which supports one end of the driving shaft 29, the other end of the shaft 29 being supported by a similar bearing (not shown) carried by the inlet manifold 23. The chamber 30 houses a gear-train 33 by which the crankshaft 4 drives a gear-wheel 34 at approximately three times the crank speed. The gear-wheel 34 has a radially extending flange 35 which is bolted to the impeller 25 so that the impeller is rotated with the gear-wheel 34. The end cover 31 is arranged with a pair of air intakes 36 (shown diagrammatically in FIG. 4), each of which has a butterfly control valve 37 for adjusting the amount of air which is drawn by the impeller and supplied through the inlet ducts 27.

The passages 16 surrounding the exhaust ports 14 lead into three separate ducts 38 formed in an exhaust manifold 39 bolted to the crank casing part 3. Each passage 16 and duct 38 together form an exhaust duct, and the three exhaust ducts lead into a passage 40 extending circumferentially around the exhaust manifold 39. The passage 40 communicates with the inlet 41 to a three-stage centrifugal turbine indicated generally at 42. The parts which form the housing (including the stators) of the three-stage turbine are bolted together and to the exhaust manifold 39. The rotors 43, 44 and 45 of the turbine 42 are connected directly to an extension 46 of the crankshaft 4, and are located in position by spacers 47 and 48 and a turbine housing end plate 49. The crankshaft extension 46 is supported by a third main bearing 50 and power may be taken from the free end 51 of the shaft 46.

An oil pump 52 is provided for circulating oil to lubricate in a conventional manner the main bearings 5, 6 and 50, the big end and little end bearings of the connecting rods 10, the drive shaft bearings 32 and 28, and other moving parts requiring lubrication. The oil circulation system includes a pipe 53 which is exposed to the air flowing through the passage 26 which serves the inlet ducts 27, so that the air flowing into the inlet ducts 27 cools the oil flowing through the pipe 53.

The engine is also provided with a fuel injection system comprising a fuel distributor (not shown) which will be mounted on the cover 31 so that it is governed by the speed of the driving shaft 29, and six individual fuel injectors 54. Each combustion chamber 12 is provided with two fuel injectors 54, one mounted in the cylinder head 11, and the other mounted in the crank casing 1 and opening into the chamber 12 through the cylinder wall. Each chamber 12 is also provided with a conventional sparking plug 55 which is mounted in the cylinder head 11 opposite the head fuel injector 54. The plugs 55 will be connected to a spark distributor (not shown) which will also be mounted on the cover 31 for control by the shaft 29.

In operation, the engine is started by means of a starter motor (not shown) which turns the driving shaft 29 and hence the crankshaft 4 until the engine fires. Turning over of the engine causes the impeller 25 to rotate approximately three times as fast as the crankshaft 4 and air is sucked through the air intakes 36 by the impeller 25 and supplied under pressure through each of the inlet ducts 27. If the inlet ports 13 of any of the cylinders 8 are open by virtue of the piston 9 being towards the lower end of the cylinder, air will enter and fill the combustion chamber 12 from the inlet duct 27. If the position of a piston 9 closes the inlet ports 13 of a cylinder 8, the air from the inlet duct will bypass the combustion chamber to the exhaust duct 38 through the cylinder head passages 19 and the crank casing passage 22.

As the piston 9 of each cylinder 8 moves up the combustion chamber past the ports 13 and 14, fuel is sprayed into the chamber 12 by the fuel injectors 54 and the air and fuel mixture is compressed until ignited by the sparking plug 55. The mixture then burns and expands to force the piston 9 down again until the ports 13 and 14 are uncovered. At this point the combustion gases escape through the exhaust ports 14 into the exhaust duct 16, 38, and fresh air from the inlet duct 27 entering the inlet ports 13 clears the chamber 12 of all exhaust products. The exhaust gases, which are hot and under pressure, escape to atmosphere through the exhaust turbine 42, causing the rotors 43, 44 and 45 to rotate and impart additional angular momentum to the crankshaft and crankshaft extension 46.

Combustion in the three cylinders 8 takes place sequentially, and at any instant, therefore, the turbine 42 is in fact driven by exhaust gases from one of the cylinders and the air which by-passes the other two cylinders and which in doing so takes up heat from the cylinders, the cylinder heads, and the crank casing surrounding the cylinders. In order to ensure that as much as possible of this heat is imparted to the air flow, and its energy converted in the turbine 42, the engine, at least surrounding the crank casing 1, the cylinder heads 11, and the inlet and exhaust manifolds 23 and 39 respectively, is enclosed in heat insulating material (as shown at 56 only in FIG. 4). Suitable insulating material would be fibreglass or asbestos wool.

I claim:

1. In an internal combustion engine including a crankshaft, a cylinder, a cylinder head, a piston reciprocably mounted in said cylinder, means drivingly connecting said piston to said crankshaft, a combustion chamber defined and bounded by said cylinder, said cylinder head, and said piston, means defining inlet ports and outlet ports for said combustion chamber, air intake means, means defining an inlet duct for conducting air fro said air intake means to said inlet ports for supply to said combustion chamber for combustion with fuel to drive said piston and hence said crankshaft, and means defining an exhaust duct communicating with said exhaust ports for conducting post combustion gases away from said combustion chamber, the improvement wherein said engine further includes an air compressor between said air intake means and said inlet duct whereby said air conducted by said inlet duct is compressed, a plurality of passage means leading from said inlet duct and extending in said engine closely around said combustion chamber whereby compressed air flows through said passage means from said inlet duct to extract heat from said engine surrounding said combustion chamber, and a turbine having a power output shaft, rotor means attached to said power output shaft, and high pressure gas inlet means communicating with said exhaust duct and said passage means whereby hot compressed gases from said combustion chamber and said passage means expand through said turbine to drive said rotor means and hence said power output shaft.

2. An engine as claimed in claim 1, further comprising heat insulating material substantially surrounding at least part of said engine to restrict heat loss to the atmosphere.

3. An engine as claimed in claim 1, wherein said passage means lead from said inlet duct to said exhaust duct.

4. An engine as claimed in claim 1, wherein said cylinder comprises a cylinder wall and peripherally spaced orifice means in said cylinder wall defining said inlet and exhaust ports, said inlet and exhaust ports communicating said combustion chamber to said inlet and exhaust ducts respectively when said ports are uncovered by said piston as said piston reciprocates in said cylinder, said engine operating on a two-stroke cycle.

5. An engine as claimed in claim 4, wherein said inlet and exhaust ports are spaced apart in a circle around said cylinder wall, and said inlet and exhaust ducts each substantially semi-encircle said cylinder.

6. An engine as claimed in claim 1, wherein at least some of said plurality of passage means pass through said cylinder head.

7. An engine as claimed in claim 1, wherein said turbine is a centrifugal turbine.

8. An engine as claimed in claim 1, wherein said turbine is a multi-stage turbine.

9. An engine as claimed in claim 1, wherein said power output shaft of said turbine is coupled to said crankshaft.

10. An engine as claimed in claim 1, wherein said air compressor comprises a centrifugal impeller, and said engine includes a gear box and means coupling said centrifugal impeller to said crankshaft through said gear box whereby said impeller is driven by said crankshaft at a speed greater than that of said crankshaft.

11. An engine as claimed in claim 10, wherein said impeller speed is between two and four times greater than said crank speed.

12. An engine as claimed in claim 1, wherein said air intake means is provided with a throttle valve for controlling the amount of air drawn into said engine through said air intake, thereby controlling the speed at which said engine runs.

13. An engine as claimed in claim 1, further including fuel injection means mounted to inject combustion fuel directly into said combustion chamber.

14. An engine as claimed in claim 1, wherein there are a plurality of said combustion chambers disposed substantially equi-angularly around said crankshaft, said piston of each of said combustion chambers being connected to said crankshaft.

15. An engine as claimed in claim 14, wherein there are three said combustion chambers.

16. An engine as claimed in claim 14, wherein said air compressor is a centrifugal impeller, and said engine includes a gear box and means coupling said centrifugal impeller to said crankshaft through said gear box whereby said impeller is driven by said crankshaft at a speed greater than that of said crankshaft, said impeller, said crankshaft and said turbine rotor means all being mounted for rotation about a common axis.

17. An engine as claimed in claim 1, further including an oil lubricating system comprising a circulating pump and a pipe through which oil in said lubrication system is pumped, said pipe being located in said air inlet duct for exposure to air passing through said air inlet duct whereby heat from said oil pumped through said pipe is given up to said air.

* * * * *